US012326317B2

(12) United States Patent
Daley

(10) Patent No.: US 12,326,317 B2
(45) Date of Patent: Jun. 10, 2025

(54) CROSSBOW RELOADING DEVICE

(71) Applicant: John R. Daley, Schuylkill Haven, PA (US)

(72) Inventor: John R. Daley, Schuylkill Haven, PA (US)

( * ) Notice: Subject to any disclaimer, the term of this patent is extended or adjusted under 35 U.S.C. 154(b) by 60 days.

(21) Appl. No.: 17/970,751

(22) Filed: Oct. 21, 2022

(65) Prior Publication Data

US 2024/0133657 A1 Apr. 25, 2024
US 2024/0230274 A9 Jul. 11, 2024

(51) Int. Cl.
*F41B 5/12* (2006.01)
*F41B 5/14* (2006.01)

(52) U.S. Cl.
CPC ..... *F41B 5/1453* (2013.01); *F41B 5/12* (2013.01); *F41B 5/1469* (2013.01)

(58) Field of Classification Search
CPC ..... F41B 5/1453; F41B 5/14; F41B 5/1469; A45F 3/44
USPC ..... 124/80, 86, 1
See application file for complete search history.

(56) References Cited

U.S. PATENT DOCUMENTS 409,239 A * 8/1889 Roller ..... A47G 25/08 248/230.8
4,708,221 A 11/1987 Kubiak
5,115,795 A * 5/1992 Farris ..... F41B 5/1469 124/25
5,857,651 A * 1/1999 Kunevicius ..... F41B 5/14 248/230.8
6,086,026 A 6/2000 Pearce
6,086,031 A * 7/2000 Renfro ..... A01M 31/02 248/230.8
6,419,097 B1 * 7/2002 Anderson ..... F41B 5/14 211/85.7
6,663,059 B1 * 12/2003 Warren ..... A45F 3/44 248/156
7,516,707 B2 * 4/2009 Schrot ..... A01M 31/02 182/187
8,302,922 B1 * 11/2012 Robinson ..... A47G 25/08 248/219.4
8,424,645 B2 4/2013 Schlipf
8,763,598 B1 * 7/2014 MacLeod ..... F41B 5/1469 124/90
10,041,756 B2 8/2018 Bednar
D837,921 S 1/2019 Wright, III
10,996,019 B2 5/2021 Liu
2006/0081748 A1 * 4/2006 Sherman ..... A47L 13/51 248/309.1
2006/0175503 A1 * 8/2006 Simonsen ..... A47K 10/12 248/315
2007/0090251 A1 * 4/2007 Padden ..... B60N 2/809 248/303
2011/0049315 A1 * 3/2011 Buckbee ..... A45F 5/00 248/219.4

(Continued)

*Primary Examiner* — John E Simms, Jr.
(74) *Attorney, Agent, or Firm* — Maier & Maier, PLLC

(57) ABSTRACT

According to at least one exemplary embodiment, a crossbow reloading device may be provided. The crossbow reloading device may have a strap that can be used to attach the device to a tree or other structure. The crossbow reloading device may have lower and upper crossbow holders that can facilitate holding a crossbow while it is reloaded. The crossbow reloading device may further have one or more attachment holders.

8 Claims, 1 Drawing Sheet

(56) References Cited

U.S. PATENT DOCUMENTS

2023/0187917 A1* 6/2023 Etzler ..... H02G 7/02
248/68.1

* cited by examiner

CROSSBOW RELOADING DEVICE

BACKGROUND

Many hunters use crossbows in order to hunt. Often hunters using a crossbow will utilize a tree stand, which is a structure attached partway up a tree, in order to gain a vantage while hunting. Currently hunters must either reload their crossbow on the ground and hoist up the loaded crossbow into the tree stand, which is both time-consuming and potentially dangerous, or utilize unwieldy crank or rope based reloading mechanisms which reduce the efficiency and ease of reloading.

Additionally, reloading a crossbow often involves placing the crossbow on the ground, placing a foot through the stirrup of the crossbow, and bending down to cock the bowstring. This process can be hard on the back, or next to impossible for individuals with bad backs.

SUMMARY

According to at least one exemplary embodiment, a crossbow reloading device may be provided. The crossbow reloading device may have a strap that can be used to attach the device to a tree or other structure. The crossbow reloading device may have lower and upper crossbow holders that can facilitate holding a crossbow while it is reloaded. The crossbow reloading device may further have one or more attachment holders.

BRIEF DESCRIPTION OF THE FIGURES

Advantages of embodiments of the present invention will be apparent from the following detailed description of the exemplary embodiments. The following detailed description should be considered in conjunction with the accompanying figures in which.

Exemplary

Exemplary

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

In an exemplary embodiment a crossbow reloading device may be fastened to a tree, for example with a strap. In other embodiments the crossbow reloading device may be otherwise fastened to the tree, for example by being bolted, fastened with a ratchet tie-down, nailed, or screwed into the tree. In some embodiments the crossbow reloading device may instead be strapped or attached to some other structure. The crossbow reloading device may have a lower holder where a crossbow may be hung. While the crossbow is being hung a cocking rope may be attached to the bow string.

After the cocking rope is attached to the bow string the crossbow may be moved from the lower holder of the crossbow reloading device to an upper holder on the crossbow reloading device. The crossbow may then be reloaded by pulling the cocking rope downward. If the crossbow reloading device is strapped or attached at a proper height it may allow for reloading without requiring the person reloading to bend their back much or at all. The crossbow reloading device may also have one or more attachment holders such as pegs that may allow for items to be hung on or stored, for example when the cocking rope is not being used it may be hung on one of the attachment holders.

Figure 1:
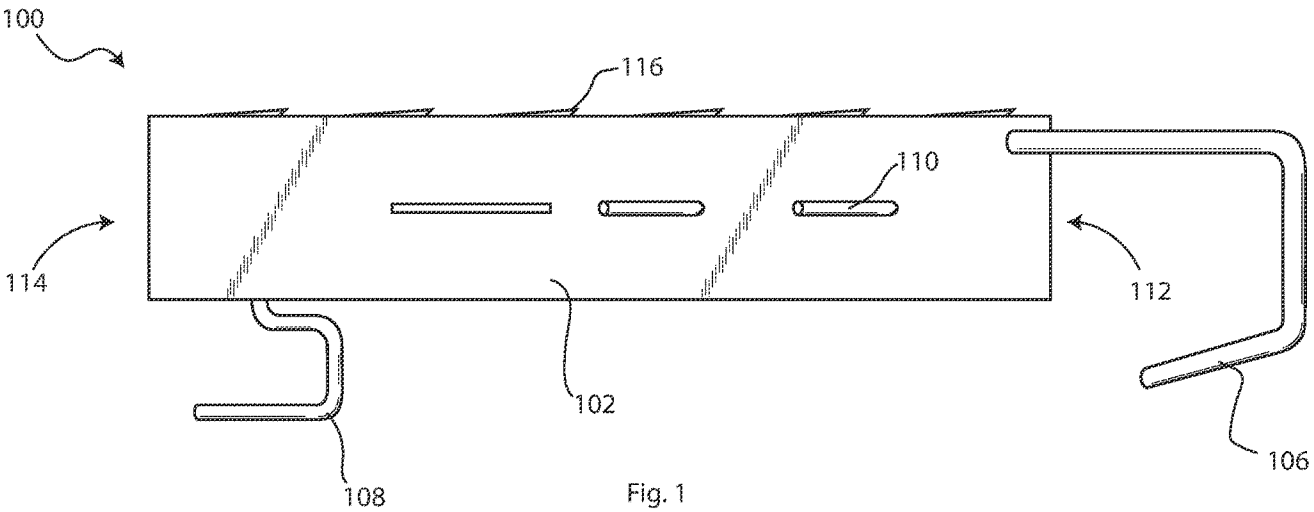
FIG. 1 shows a side view of an exemplary embodiment of a crossbow reloading device.
Figure 2:
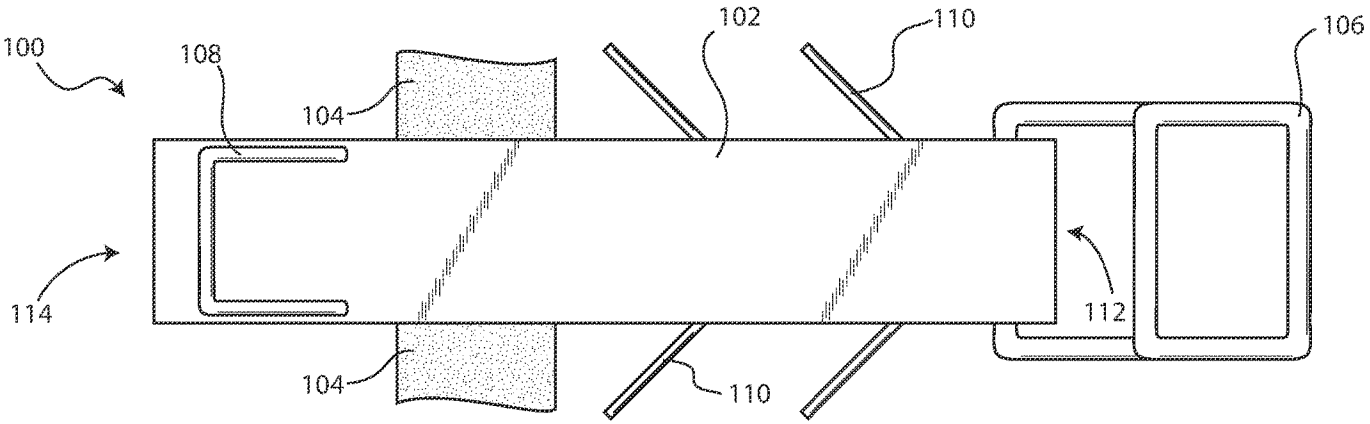
FIG. 2 shows a top view of an exemplary embodiment of a crossbow reloading device.

Referring to exemplary FIGS. 1-2, an exemplary crossbow reloading device 100 top view and side view are shown. The crossbow reloading device 100 may have a base 102. The base 102 may be made of, for example, molded plastic. In other embodiments the base 102 may be made of metal, plastic, sturdy wood, or some other material known in the art. The base 102 may have a first end 112 and a second end 114. The base 102 may be fastened to a tree with a strap 104. The strap 104 may be made of any of, but is not limited to, nylon, leather, rope, polyester, steel, or any other material known in the art The strap 104 may further contain a connecting hook and/or a rubber coated d-ring, which may allow the body 100 to attach to a tree or other surface quietly and strongly. The strap 104 may be attached to the base 102 and may loop around the tree to hold the base 102 in place. Alternatively, the strap 104 may not be connected to the base 102 and may wrap around the base 102 and tie off against itself to hold the base 102 up to the tree. The strap 104 may also pass through the base 102. In some embodiments more than one strap 104 may be used, for example one on the bottom of the base 102 and one at the top of the base 102.

The crossbow reloading device 100 may further have a lower holder 106. The lower holder 106 may be made of any of, but is not limited to, steel, wood, plastic, rebar, or any other material known in the art, and may be, for example but not limited to, ¼", ⅝", or ⅜" thick material. The lower holder 106 may be u-shaped so as to be able to hold a crossbow or other object in place. The lower holder 106 may be coated in rubber or another material. The lower holder 106 may be attached to the base 102, for example by being glued onto, drilled into, or any other method known in the art. The lower holder may be attached to the lower part of the base 102, for example the lower holder may be attached in the bottom portion of the base 102, when attached to the tree or other structure, and go below the bottom of the base 102. The crossbow reloading device 100 may further have an upper holder 108. The upper holder 108 may be made of any of, but is not limited to, steel, wood, plastic, rebar, or any other material known in the art, and may be, for example but not limited to, ¼", ⅝", or ⅜" thick material. The upper holder 108 may be u-shaped so as to be able to hold a crossbow or other object in place. The upper holder 108 may be coated in rubber or another material. The upper holder 108 may be attached to the base 102, for example by being glued onto, drilled into, or any other method known in the art. The upper holder 108 may be located on the top portion of the base 102 when attached to the tree or other structure.

The crossbow reloading device 100 may have one or more attachment holders 110, which may be, for example, pegs. In various exemplary embodiments there may be 1 attachment holder, 2 attachment's holders with one on each side, 4 attachment holders with two on each side, etc. The attachment holders 110 may be made of wood, metal, plastic, or any other material known in the art, and may be, for example, 1" long. The attachment holders 110 may be rubber coated. The attachment holders 110 may be attached to the sides of the base 102. The attachment holders may be straight posts, or maybe be another shape, for example curved or hook-shaped in order to hold different kinds of equipment or may be placed at an angle so items don't fall off during use.

The base 102 of the crossbow reloading device 100 may further have a plurality of extended material or ridges 116. The plurality of extended material or ridges 116 may provide grip or prevent slipping when the crossbow reloading device 100 is strapped to a tree or other supporting object. The plurality of extended material or ridges 116 may be made out of the same material as the base 102, or may be made out of a different material such as, but not limited to, metal, plastic, sturdy wood, or some other material known in the art.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A method for using a crossbow reloading device comprising:

securing the crossbow reloading device to a support object, by using a strap, wherein the crossbow reloading device includes a base and the strap affixed to the base, a u-shaped upper retaining member and a u-shaped lower retaining member, the base comprises a plurality of ridges and the plurality of ridges are configured to provide grip or prevent slipping when the crossbow reloading device is strapped to a tree or other supporting object;

placing a crossbow on one or more of the u-shaped upper retaining member and the u-shaped lower retaining member of the crossbow reloading device;

applying pressure to a bowstring of the crossbow in order to cock it; and removing the crossbow from the crossbow reloading device;

wherein the u-shaped upper retaining member is configured to hold the crossbow so that the crossbow is stabilized while the crossbow is cocked.

2. The method of claim 1, wherein the step of placing a crossbow on one or more of the u-shaped upper retaining member and the u-shaped lower retaining member of the crossbow reloading device is placing the crossbow on the lower retaining member;

the method further comprising:

attaching a cocking rope to the crossbow string;

moving the crossbow to the upper retaining member; and pulling on the cocking rope in order to cock the crossbow.

3. The method of claim 1, wherein the crossbow reloading device further includes at least one attachment holder connected to the base and configured to hold one or more attachments.

4. The method of claim 1, wherein the crossbow reloading device further includes four attachment holders connected the base and configured to hold one or more attachments, wherein two of the four attachment holders are attached to a first side of the base and two of the four attachment holders are attached to a second side of the base opposite the first side of the base.

5. The method of claim 4, wherein the four attachment holders are attached at an angle relative to a bottom of the crossbow reloading device.

6. The method of claim 3, wherein the base is substantially rectangular.

7. The method of claim 3, wherein the lower retaining member and upper retaining member are hooks.

8. The method of claim 7, wherein the lower retaining member and upper retaining member are comprised of rubberized metal rods.

* * * * *